United States Patent [19]

Cordeiro

[11] 4,195,565

[45] Apr. 1, 1980

[54] FLUID-OPERATED PRESS

[75] Inventor: August V. Cordeiro, East Greenwich, R.I.

[73] Assignee: Electric Terminal Corporation, Warwick, R.I.

[21] Appl. No.: 21,000

[22] Filed: Mar. 16, 1979

[51] Int. Cl.[2] ..... B30B 1/38

[52] U.S. Cl. ..... 100/266; 83/590; 83/639; 100/269 R; 100/53

[58] Field of Search ..... 100/266, 53, 269 R; 92/177; 83/588, 590, 637, 639

[56] References Cited

U.S. PATENT DOCUMENTS

| | | | |
|---|---|---|---|
| 2,983,256 | 5/1961 | Seeloff | 92/177 X |
| 3,174,377 | 3/1965 | Lischer | 83/639 X |
| 3,788,198 | 1/1974 | Check | 92/177 X |
| 3,961,559 | 6/1976 | Teramachi | 92/177 X |
| 4,022,090 | 5/1977 | Doherty | 83/588 X |

FOREIGN PATENT DOCUMENTS

| | | | |
|---|---|---|---|
| 277952 | 9/1930 | Italy | 100/266 |

*Primary Examiner*—Billy J. Wilhite

[57] ABSTRACT

A fluid-operated press featuring a cavity and piston within its base for pulling down on an elevated tool holder.

9 Claims, 5 Drawing Figures

FLUID-OPERATED PRESS

FIELD OF THE INVENTION

This invention relates to fluid-operated presses.

BACKGROUND OF THE INVENTION

Fluid-operated presses are used in many applications, e.g., in stamping metal parts. Conventional presses have generally been quite bulky, taking up relatively large volumes to provide space for a fluid cylinder and piston. One reason for this has been that such presses have generally employed elevated cylinders that pushed down on the workpiece.

Doherty et al., U.S. Pat. No. 4,022,090 shows an electrically operated punch press with an oblong solenoid coil and armature located in the base for pulling down on the tool holder. Oblong-shaped, fluid-operated pistons are shown in U.S. Pat. Nos. 3,961,559; 3,788,198; and 2,983,256.

SUMMARY OF THE INVENTION

I have discovered that a fluid-operated press can be made more compact and less costly by providing within the base a piston cavity in which a piston slides vertically. My invention places the piston below an elevated tool holder so that it pulls rather than pushes on the tool holder, and it uses otherwise wasted space in the base. Furthermore, the press can be made from a small number of parts, and its small size makes it portable.

In preferred embodiments, two rods connect the piston with an elevated tool holder, the rods extending through openings in the base; the base includes an integral reservoir, to further conserve space; the reservoir and the piston cavity are formed by apertures in a central plate cooperating with top and bottom plates of the base; the piston is oblong-shaped to maximize its working area; a seal is provided between the piston and the cavity; and a compression spring is mounted between the tool holder and the base to return the member to its starting position when pressure on the piston is removed.

PREFERRED EMBODIMENT

The structure and operation of a preferred embodiment of the invention will now be described, after first briefly describing the drawings.

Drawings

Structure

Figure 1:
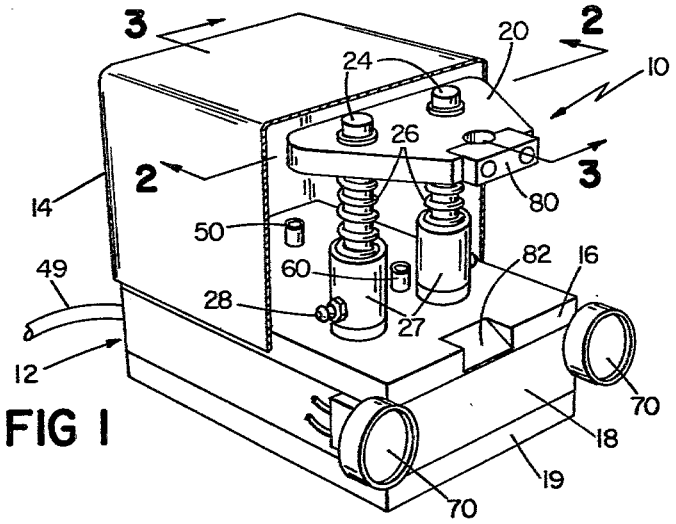
FIG. 1 is a perspective view of said preferred embodiment, showing the cover partially cutaway.
Figure 2:
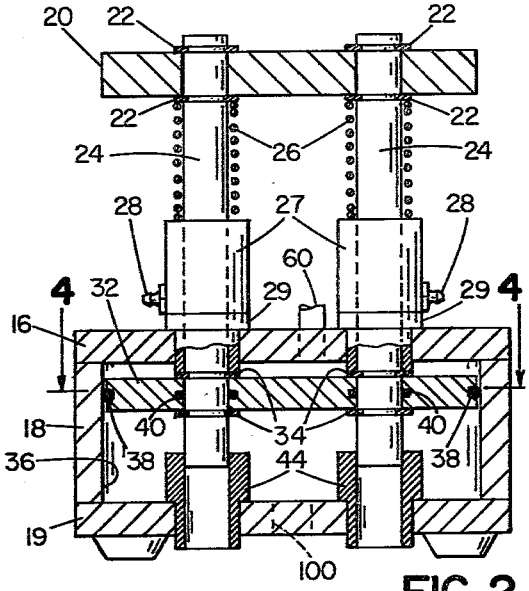
FIG. 2 is a vertical cross-sectional view at 2 2 of FIG. 1.
Figure 3:
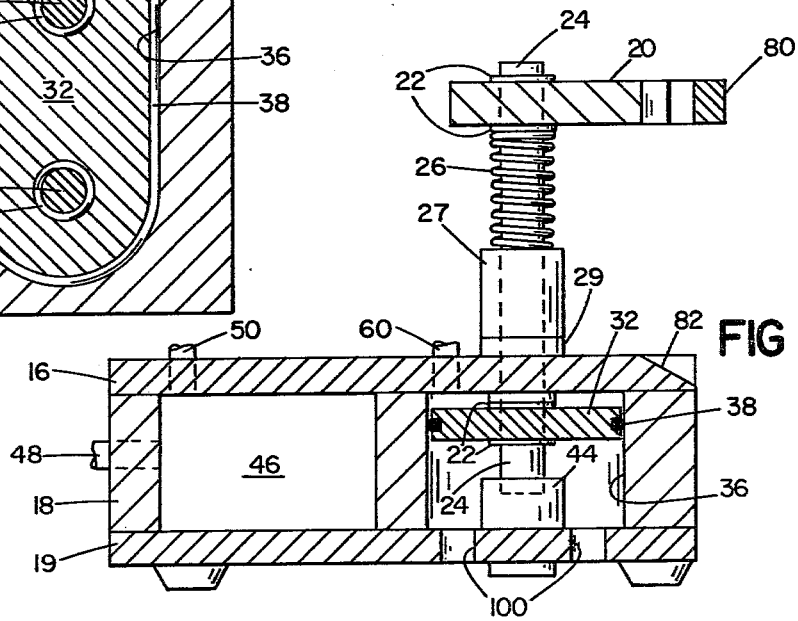
FIG. 3 is a vertical cross-sectional view at 3—3 of FIG. 1.

Turning to FIG. 1, there is shown pneumatic press 10 with base 12, cover 14 (partially cut away), and elevated tool holder 20. Base 12 consists of top plate 16, central plate 18, and bottom plate 19 (FIG. 3). Holder 20 is fastened by retaining rings 22 (FIG. 2) to rods 24. Springs 26 fit over the rods and provide a return force. Rods 24 pass through sleeves 27 and bushings 29. The bushings are press fitted in holes in top plate 16 of base 12. The rods are lubricated with grease through fittings 28.

Figure 4:
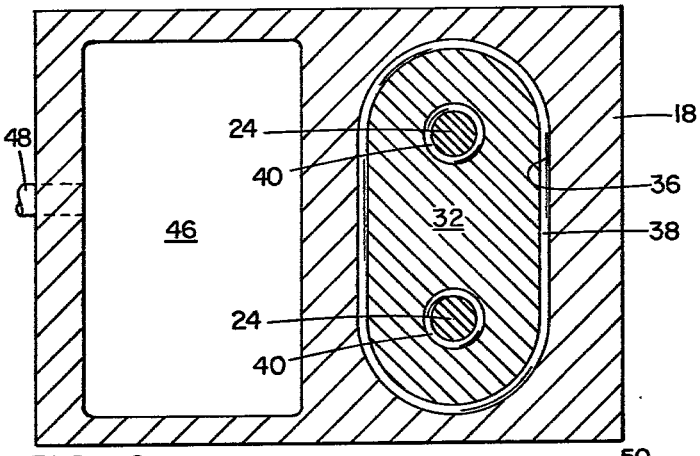
FIG. 4 is a horizontal cross-sectional view at 4—4 of FIG. 2.

Rods 24 are fastened to piston 32 by retaining rings 34. Piston 32 is oblong shaped (FIG. 4), and slides vertically within matching oblong shaped cavity 36 in base 12. Piston cavity 36 is formed by cutting an aperture in central plate 18 of the base. A first O-ring seal 38 extends around the periphery of piston 32 in a groove. Second O-ring seals 40 extend around each of rods 24 in further grooves positioned vertically midway between the top and bottom of the piston. The ends of rods 24 slide in bushings 44 press fitted within bottom plate 19 of base 12. Vent holes 100 are provided in base 19.

Referring to FIG. 3, there is shown pneumatic reservoir 46 formed within base 12 behind piston cavity 36. Like piston cavity 36, reservoir 46 is formed by an aperture cut in central plate 18. Inlet fitting 48 in the back wall of reservoir 46 connects air supply line 49 (FIG. 1) to the reservoir. Outlet fitting 50 connects the reservoir through main valve 56 (FIG. 5) to piston cavity 36.

Figure 5:
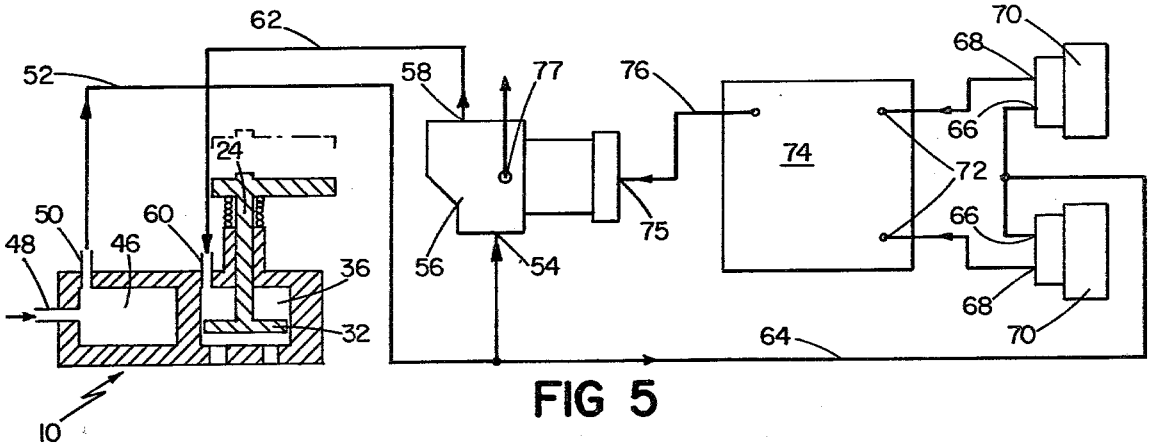
FIG. 5 is a schematic of the pneumatic system of said embodiment.

Referring to FIG. 5, line 52 connects reservoir outlet 50 to inlet 54 of pilot-operated main valve 56. Outlet 58 of main valve 56 is connected to inlet 60 of piston cavity 36 through line 62. Line 64 is an extension of line 52 and connects the high pressure output of reservoir 46 to inlets 66 of operating valves 70. Outlets 68 of valves 70 are connected in inlets 72 of pneumatic logic unit 74. The outlet of pneumatic logic unit 74 is connected to pilot inlet 75 of main valve 56 through line 76. Outlet 77 of main valve 56 provides an escape outlet for air when the main valve is shut off. The pneumatic lines, valve 56 and unit 74, are shown only in the schematic of FIG. 5. Valve 56 and unit 74 are physically located above reservoir 46 on the upper surface of top plate 16.

Operation

In operation, operating valves 70 must both be simultaneously pressed to operate the press, thereby assuring that the operator has not left one hand beneath the tool. When pressure is sensed at both inlets 72 to logic unit 74, the unit completes the connection of high pressure air to pilot inlet 75 of main valve 56, and causes valve 56 to open. This dumps the stored volume of pressurized air in reservoir 46 into piston cavity 36, driving piston 32 downward. Storing air near the piston permits a high flow rate of air to speed piston movement. Rods 24 travel downward with the piston, and transfer the piston force to tool holder 20. Clamp 80 on the forward end of holder 20 is used to mount a removable tool (not shown, and well known in the art) on the press. The tool typically includes a die and anvil and guide rods for aligning the die and anvil during movement. Slot 82 in base 12 provides a path for finished pieces to drop from the tool.

When either of operating valves 70 is released, main valve 56 is opened, dumping air through outlet 77 and releasing piston 32. Springs 26 force the piston and holder 20 upward.

Other embodiments of the invention will occur to those skilled in the art and are within the scope of the following claims.

What is claimed is:

1. A fluid-operated press, comprising, a base, a piston and rod, said base having a first cavity shaped to receive said piston, said piston being shaped and positioned to slide vertically within said cavity while sealed to the vertical walls of said cavity, and said rod extending upward from said piston and base through an opening in said base, and a tool holder connected to the upper end of said rod and elevated above said base, whereby pressurized fluid can be supplied to the upper side of said piston to force said piston downward to thereby pull downward on said tool holder so as to compress a workpiece positioned between said holder and said base.

2. The press of claim 1 whereing said base further includes a second cavity forming an integral reservoir adjacent said piston cavity, said reservoir providing storage volume for the fluid operating said piston to thereby speed movement of said piston.

3. The press of claim 2 wherein said base includes a top plate with said opening for said rod, a central portion with vertical apertures forming said first and second cavities, and a bottom plate.

4. The press of claim 1 or 3 further comprising a second rod connecting said piston and said tool holder, said second rod extending through another opening in said base, and wherein said piston is oblong shaped in horizontal cross section, whereby the working area of said piston is increased.

5. The press of claim 1 further comprising a compression spring between said base and said tool holder for returning said holder to its starting position after the force on said piston is removed.

6. The press of claim 4 wherein said rods are guided in sleeves fixed to said base.

7. The press of claim 4 further comprising a seal running around the periphery of said oblong piston, said seal cooperating with the wall of said piston cavity to prevent escape of fluid.

8. The press of claim 7 wherein said rods extend through holes in said piston and are connected to said piston by retaining rings.

9. The press of claim 8 wherein said press further comprises second seals extending around said rods in the region at which they pass through said piston, to prevent escape of fluid.

* * * * *

Disclaimer 4,195,565.—*August V. Cordeiro*, East Greenwich, R.I. FLUID-OPERATED PRESS. Patent dated Apr. 1, 1980. Disclaimer filed Aug. 18, 1980, by the assignee, *Electric Terminal Corporation.*

Hereby enters this disclaimer to claims 1 and 5 of said patent.

[*Official Gazette October 14, 1980.*]